US006066816A

United States Patent [19]

Benger

[11] Patent Number: 6,066,816

[45] Date of Patent: May 23, 2000

[54] SWITCH HOUSING FOR AN ELECTRIC SWITCH

[75] Inventor: Fritz Benger, Oberbuchsiten, Switzerland

[73] Assignee: Elektro-Apparatebau Olten AG, Olten, Switzerland

[21] Appl. No.: 09/246,457

[22] Filed: Feb. 9, 1999

[30] Foreign Application Priority Data

Feb. 9, 1998 [EP] European Pat. Off. ..... 98810093

[51] Int. Cl.[7] ..... H01H 9/00

[52] U.S. Cl. ..... 200/296

[58] Field of Search ..... 200/5 A, 6 R, 200/11 R, 16 R, 50.02, 20.12, 50.14, 517, 520, 537, 553, 564, 293, 295, 296, 303, 307, 329, 336, 339, 341, 345

[56] References Cited

U.S. PATENT DOCUMENTS

| | | | |
|---|---|---|---|
| 3,673,365 | 6/1972 | Schadow | 200/16 R |
| 3,681,552 | 8/1972 | Bailey | 200/168 C |
| 4,590,342 | 5/1986 | Schlegel | 200/159 B |
| 5,099,094 | 3/1992 | Torma et al. | 200/296 |
| 5,178,504 | 1/1993 | Falchi | 411/553 |
| 5,201,408 | 4/1993 | Torma et al. | 200/294 |
| 5,401,925 | 3/1995 | Sambar | 200/296 |

FOREIGN PATENT DOCUMENTS

| | | | |
|---|---|---|---|
| 3901533 | 8/1990 | Germany | H05K 3/30 |
| 9300630 | 5/1994 | Germany | H01H 13/04 |
| 2213644 | 8/1989 | United Kingdom | G05G 1/00 |

OTHER PUBLICATIONS

Patent Abstracts of Japan, vol. 095, No. 003, Apr. 28, 1995 & JP 06 349373 A (Asahi Natl Shomei KK) Dec. 22, 1994, Abstract.

*Primary Examiner*—Michael Friedhofer
*Attorney, Agent, or Firm*—Martin A. Farber

[57] ABSTRACT

A switch housing for an electric switch has a front end with a stop surface for contacting a front plate with a fastening element. Furthermore, the switch housing has on its rear a mounting surface parallel to the stop surface, to be fastened with the mounting surface on a printed circuit board. In this arrangement, the switch housing is assembled from two elements of which one switch element is brought into connection with the front plate, and for the other switch element is connected to the printed circuit board. One of the two elements has a clip which connects with a locking pin arranged in the other one of the two elements or capable of being pushed forward, with the result that the two switch elements of the switch housing make effective functional contact with one another. This renders it possible for a printed circuit board provided with the first preassembled elements of the switch housings to be assembled durably and yet detachably with a front plate provided with the other preassembled elements of the switch housings, without the need to provide additional spacing elements.

10 Claims, 3 Drawing Sheets

SWITCH HOUSING FOR AN ELECTRIC SWITCH

FIELD AND BACKGROUND OF THE INVENTION

The invention relates to a switch housing for an electric switch on the front end of which there is present a stop surface which acts against a front plate (30) and can be brought to stop against the front plate (30) with a fastening element (3), the switch housing having on its rear a mounting surface (36) parallel to the stop surface, and it being possible for the switch housing to be fastened with the mounting surface (36) on a printed circuit board (10).

A switch housing of the type mentioned at the beginning is known from EP 0 402 609. Such a switch is operated in a switchboard or switch gallery from the front of the switch-board. In general, a series of such switches projects uniformly over the front plate. The switch housings are mostly connected at the rear to printed circuit boards which must be accurately spaced from the front plate. In the case of the printed publication, mentioned above, the switch housing is provided with a flange so that said housing can be fastened directly in each case on a printed circuit board.

It is thereby possible to avoid the spacing bolts which are otherwise known in the prior art and require a high outlay on mounting. However, the switch housings according to EP-A-0 402 609 have the disadvantage that they must be mounted on the printed circuit board in a separate work operation. Once a connection with the printed circuit board has been taken up, they can no longer easily be separated and are thus not easy to service.

SUMMARY OF THE INVENTION

Starting from this prior art, it is the forgoing object of the invention to specify a switch housing of the type which renders it possible to connect a switch to the printed circuit board assigned to it in a simple way electrically and mechanically.

This object is achieved according to the invention by the fact that the switch housing is assembled from two elements (1, 2) such that one switch element (1) can be brought into connection with the front plate (30) and that the other switch element (2) can be connected to the printed circuit board (10), and that one of the two elements (1 or 2) has a clip (5, 15) which can be brought into connection with a locking pin (20; 40) arranged in the other one of the two elements (2 or 1) or capable of being pushed forward, with the result that the two switch elements (1 and 2) of the switch housing make effective functional contact with one another.

Owing to the fact that the switch housing comprises two elements which are assembled in a modular fashion, and can be preassembled and easily combined, the switches comprising these switch housings can be mounted very easily and, in addition, be replaced in a simple way, thereby being easy to service. This renders it possible for a printed circuit board provided with the first preassembled elements of the switch housings to be assembled durably and yet detachably with a front plate provided with the other preassembled elements of the switch housings, without the need to provide additional spacing elements.

BRIEF DESCRIPTION OF THE DRAWINGS

The invention will now be explained by way of example using exemplary embodiments with the aid of the enclosed diagrammatic drawings, in which.

DETAILED DESCRIPTION OF THE PREFERRED EMBODIMENTS

Figure 1:
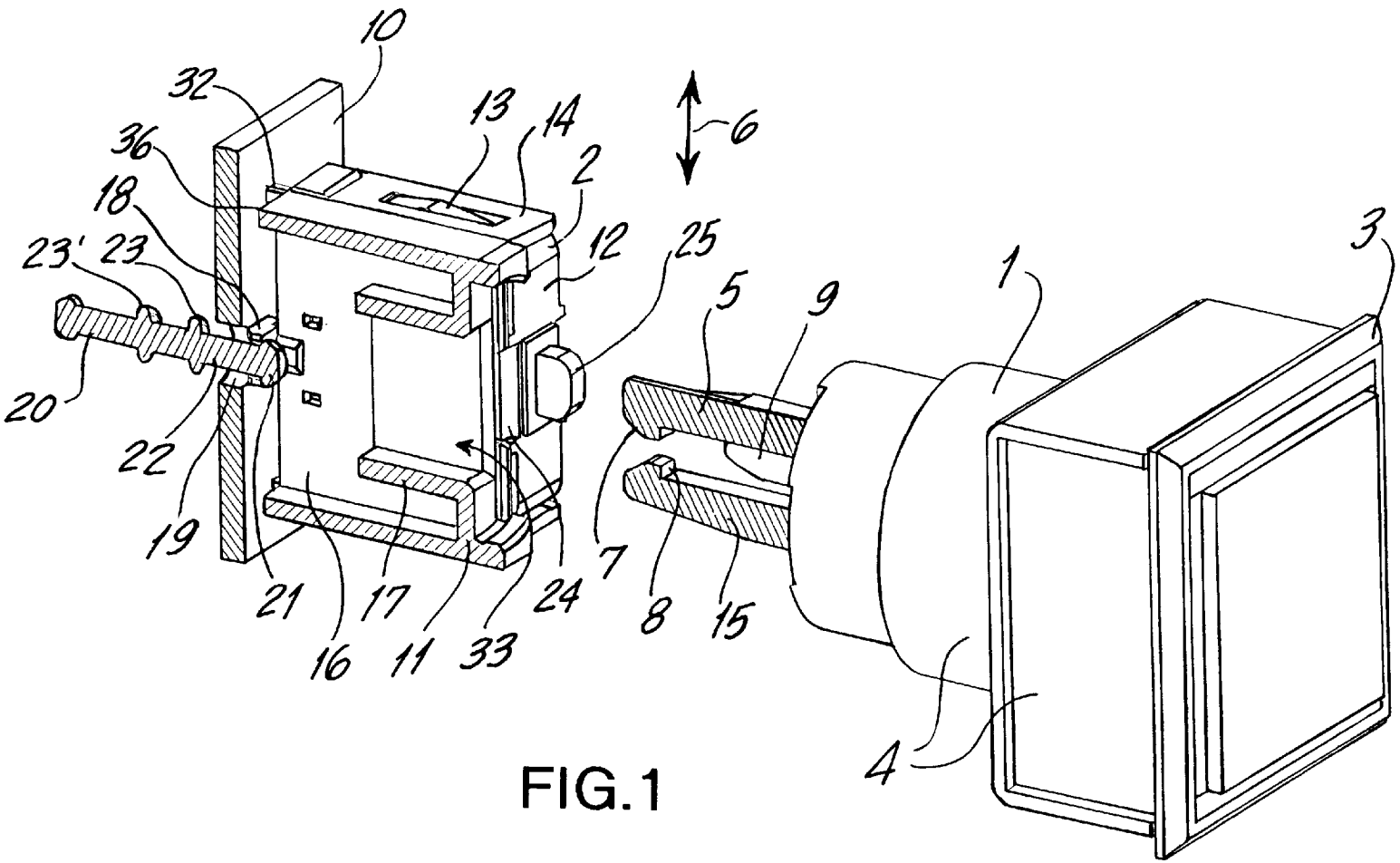
FIG. 1 shows a perspective representation of a partially sectioned switch housing in accordance with a first exemplary embodiment, before assembly.

FIG. 1 shows a diagrammatic representation of a partially sectioned view of a switch housing in accordance with an exemplary embodiment of the invention.

The switch housing comprises two elements which are provided with the reference numerals 1 and 2. The switch element 1 has a projecting circumferential rim 3 which projects beyond the front of an operating surface or front plate 30 of a switchboard, as is to be seen in FIG. 2. The body 4 of the switch element 1 is consequently located behind the front plate of the switchboard. The switch represented is a changeover switch which has an operating surface of square configuration, and internal lighting. The front shape of the switch can, however, likewise be selected to be round or rectangular. The switch element 1 can, for example, be an on-off switch, a two-way switch or a key-operated switch. The function of the switch element 1 depends on the operating front selected.

The switch element 1 in each case has two resilient elements 5 and 15 which can be moved in an elastic way in the directions of the double arrow 6. The spring elements 5 and 15 run parallel to the longitudinal axis 35 of the switch housing. They advantageously have on their lower end a run-up ramp 7 which ends in an inwardly bent and overhanging hook element 8.

The reference numeral 9 denotes an electric contact which is provided in cooperation with the opposite second electric contact—not represented by the sectional view of FIG. 1, for the purpose of switching on the luminous element provided in the switch element 1. Of course, the electric contacts 9 can be omitted if no corresponding illumination function is provided in the switch element 1. The complementary base element 2, situated opposite the switch element 1 is fastened on the printed circuit board 10. This can be performed by a number of methods, in particular by soldering the electric connections between the wiring provided on the printed circuit board 10 and the assigned contact pins of the base element 2.

The base element 2 is represented in a sectioned representation, in particular the mounting element 11 being represented completely sectioned and halved. The reference numeral 12 denotes one switch unit which has lateral latching attachments 13 which latch in lateral wings 14 of the mounting element 11. The switch unit 12 has, in particular, a plunger 25 which, with a complementary element provided in the switch element 1, triggers the actual switching operation in the complementary switch unit 12.

A second switch unit 12 of the same structural configuration as the half of the base element 2 represented here can be provided on the opposite side of the mounting element 11. The arrangement of the switch unit 12 and, with them, the assigned plunger (25), depends on the selected switching function of the switch comprising the elements 1 and 2. Particularly in the case of keys, it is also possible to provide only a single switch unit 12, the space provided in the mounting element 11 being filled up by a dummy element.

It is to be seen, in particular, that the mounting element 11 has between two switch element s 12 a cavity 16 which limits the opening 33 for the resilient elements 5 and 15 by two lateral guides 17.

From the base side, the mounting element 11 has a guide 18, which exposes an annular opening and is arranged exactly over a correspondingly predrilled hole 19 in the printed circuit board 10. A locking pin 20 with the longitudinal axis 35 is pushed forward through this hole 19 in an aligned fashion into the mounting element 11. The mounting element 11 forms with its rear 36 a stop surface which is seated on the printed circuit board 10 at least at correspondingly provided surfaces or points.

As represented in FIG. 1, the locking pin 20 is preferably of symmetrical design. It has a locking head 21 and, adjacent thereto, a shaft 22 which is adjoined by a locking cam 23. As mentioned, after a short middle shaft, these elements then appear again on the other side of the locking pin, with the result that there is no need during assembly to pay heed to how the locking pin 20 is orientated when it is pushed forward through the hole 19 into the printed circuit board 10. The reference numerals for the symmetrically configured elements discussed here are expressed in each case with primes. In the case of a different configuration of the locking pins 20, the latter can also be of asymmetrical configuration and, in particular, can have a grip knob which can be gripped particularly effectively.

The function of the locking of the switch housing can now easily be seen. In general, the switch element 1 is already firmly connected to the front plate. Subsequently, the printed circuit board 10 is pushed forward with the base element 2 premounted thereon toward the switch element 1. In this case, the resilient ends 5 and 15 fit through the opening 33 into the cavity 16, and the electric contacts 9, if provided, slide in receptacles 24 which correspond to them and in which the electric contact is made. Subsequently, the locking pin 20 is inserted into the assembled base element 2 and switch element 1, with the result that the resilient ends 5 and 15 lock with the locking head 21. This results in a reliable and firm connection between the front plate of the switchboard and the printed circuit board 10 assigned to it, without the need to use spacing bolts.

Figure 2:
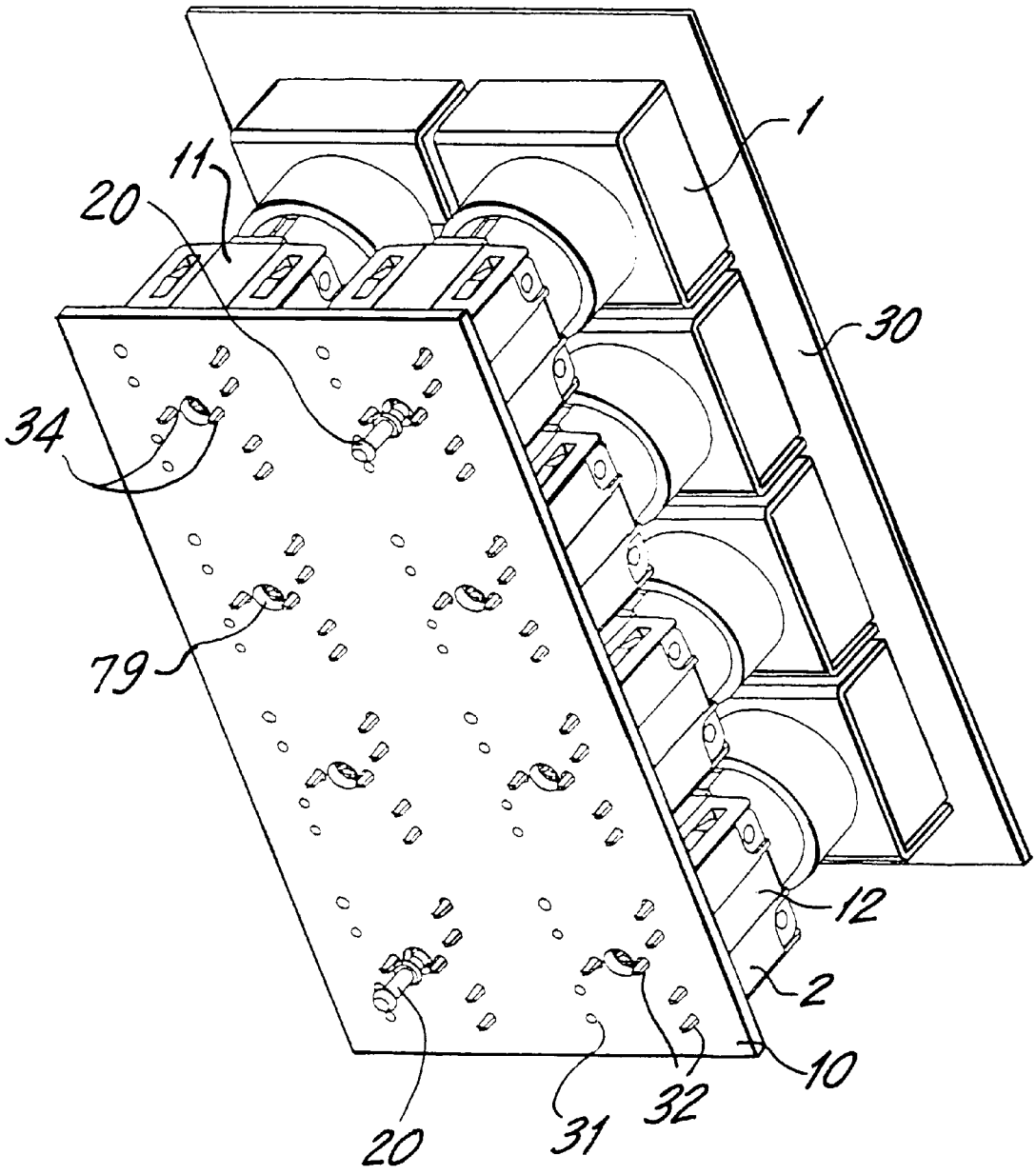
FIG. 2 shows a top view of the core housing of a switch housing according to FIG. 1, and FIGS. 3 to 5 show a side view, a bottom view and a partially sectioned view of a pin in accordance with a second exemplary embodiment.

FIG. 2 shows a diagrammatic view of an arrangement of eight switch elements in a prescribed matrix with the use of the switch housings according to the invention. Identical features are marked in all the figures by identical reference numerals.

It is to be seen, in particular, in FIG. 2 that the front switch elements 1 are inserted in a front plate 30. In this case, the arrangement of the switches prescribes a matrix which is to be observed by the electronic system. The latter has a printed circuit board 10, of which, of course, only the section of interest with the associated base elements 2 is represented here. It may be seen at once that recourse may be made to a standardized printed circuit board which has eight contact surfaces 31 for each switch in the case represented here. Moreover, two bores 34 are provided through which the contacts 32 for the illumination function of each switch element 1 can project through the printed circuit board 10. Furthermore, the holes 19 for guiding the pins 20 through into the printed circuit board are provided for each switch in a fashion appropriately centered and concentric with the longitudinal axis 35.

It is clearly to be seen that with the base elements 2 a switch element is available which can be connected directly to the printed circuit board 10 and has a standardized layout. The outlay on wiring for the switch arrangement can thereby be reduced. These base elements 2 are fastened, for example soldered, in advance on the printed circuit board 10 with their mounting element 11 and the two mutually opposite switch units 12 provided per switch in each case. Similarly, the individual switch elements 1 are mounted on the front plate 30 independently thereof.

By inserting the spring elements 5 and 15 into the corresponding cavities 16 of the mounting elements 11, the two individual preassembled modules are now joined together. This interface is simple and does not depend on manufacturing tolerances. The mechanical connection is rendered possible by the preferably symmetrically fitted pull-and-push pin 20, which is inserted at a predetermined number of switch housings. In the represented exemplary embodiment of a switch arrangement of two times four elements, it is sufficient, as represented, to provide a single locking pin 20 in each case at diagonally opposite corners. In the case of larger switch arrangements and larger printed circuit boards, locking pins 20 are to be arranged, in particular, at all the corners of the switch arrangements, as well as at points of symmetry lying centrally therebetween.

Handling this connection of the pin 20 with the spring elements 5 and 15 is very simple, since the switch elements 1 can be released by simply pressing on the pins 20 and pulling on the printed circuit board 10. Consequently, this connection can be effected without an additional mounting tool both when being produced and when being released on the rear of the printed circuit board.

Thus, there are no additional mechanical connections, for example spacers, nor is there a need to prefabricate the switch units. In particular, the switch elements 1 can easily be changed in any way, without changing the circuit. In the same way, the effective switch elements 12 can be removed from the mounting element 11 and replaced.

In the represented exemplary embodiment, the resilient elements 5, 15 are provided on the switch element 1 on the side of the front plate, and the locking pin 20 engaging therein is pushed forward from the rear of the printed circuit board. Of course, an inverted arrangement of the elements of the mechanical connection is also possible. That is to say, there is provided on the switch element 1 a pin which is advantageously arranged symmetrically relative to the longitudinal axis 35 and has a locking head. Provided opposite thereto in the base element 2 in the region of the cavity 16 represented in FIG. 1 are a pair of clips which grip the pin when the two elements 1 and 2 are pushed in. This arrangement has the advantage that there is no need to provide bores in the printed circuit board 10. In exchange, it is disadvantageous that in general each switch unit has such a latching connection, and this leads to substantial forces which have to be applied in the case of a large number of switch housings. Of course, it is also possible to provide two types of mounting elements 11 in the base elements 2, one type with spring elements and one type without the latter.

In a further modification (not represented in the figures) of the above-described exemplary embodiment, the switch element 1 has said first pin arranged symmetrically relative to the longitudinal axis 35. Provided opposite it is a second pin, which has a shaft which projects from the printed circuit board 10 and is remote from the switch element 1 and which then branches like a fork in the direction of the switch element 1 in order to grip the first pin and lock it.

Figure 5:
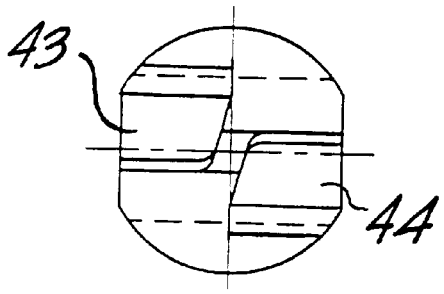
Figure 3:
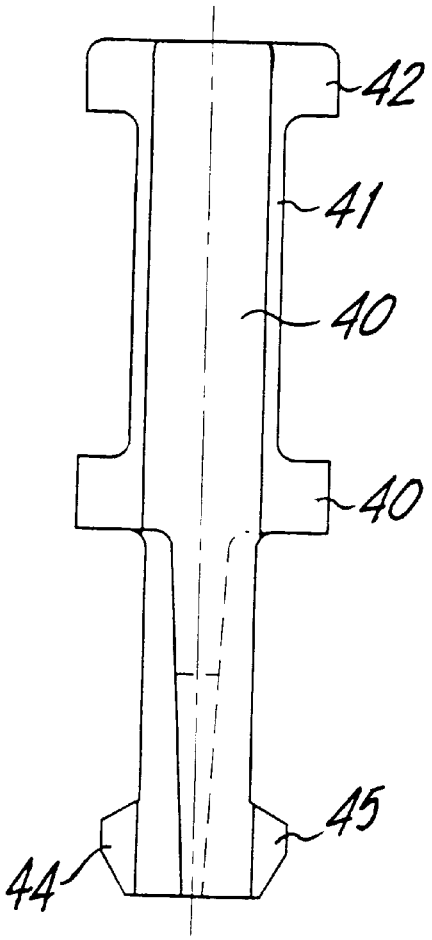
Figure 4:
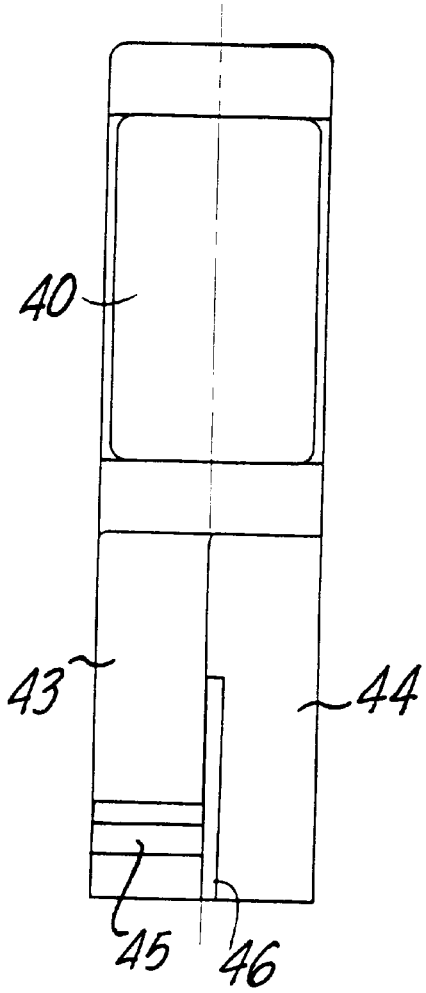

Finally, FIGS. 3 to 5 show a side view, a bottom view and a partially sectioned view of a pin 40 in accordance with a second exemplary embodiment. In this case, the clip elements 5 and 15 aligned in accordance with FIG. 1 are, however, of rigid design. Provided opposite these is a pin 40 which has a shaft 41 which projects from the printed circuit board 10 and is remote from the switch element 1 and which has two holding webs 42. It branches in the direction of the switch element 1 into two spring limbs 43 and 44 which are separated by a slot 46 and, in a particularly advantageous way, have cams 45 for the purpose of engaging with the hooks 8 in the elements 5 and 15 (which are rigid here), and to lock the printed circuit board 10 relative to the front plate.

Finally, it is possible in the case of all the exemplary embodiments to select the number of the resilient elements 5 and 15 or 43 and 44 in another way, in particular to be three or four. It is also possible for the tips of the resilient elements not to be fitted with hooks 8, and for the pin 20 to terminate in the shape of a wedge, for example. Here, the locking would then be indicated to the user by the locking cam 23 coming to lie behind the guide 18. Up to this point, the, for example, frustoconical pin 20 must be pushed forward into the resilient elements 5 and 15 tapering in the enclosed free space about the longitudinal axis 35.

An eccentric arrangement is also possible in addition to the represented aligned orientation of the elements 1, 2, 5, 15 and 20 with the longitudinal axis 35 of the switch housing. However, such an arrangement has the disadvantage of the asymmetrical force loading of the switch housing. It is also possible, however, in particular to provide two locking pins 20 which are arranged symmetrically relative to the longitudinal axis 35.

I claim:

1. A switch housing for an electric switch, the housing being suitable for positioning the switch at a front plate by means of a fastening element, and wherein a stop surface is located on a front end of the housing for contacting the front plate, wherein there is located on a rear of the housing a mounting surface which is parallel to the stop surface and enables the switch housing to be fastened via the mounting surface on a printed circuit board, wherein the switch housing comprises:

first and second switch elements such that one of said switch elements is connectable with the front plate, and that the other of said switch elements is connectable to the printed circuit board;

wherein one of said switch elements has a clip and the other of said switch elements has a locking pin, and the clip is adapted for connection with the locking pin for enabling said first and second switch elements to make effective functional contact with one another, both of the clip and the locking pin being disposed along a central axis of the switch housing.

2. The switch housing as claimed in claim 1, wherein the locking pin has a locking head, and the clip is connectable with the locking head of the locking pin.

3. The switch housing as claimed in claim 1, wherein the clip is of resilient configuration and has at least two clip arms.

4. The switch housing as claimed in claim 1, wherein said second switch element has a cavity, and said first switch element comprises an operating key and two clip arms which engage in the cavity of said second switch element, while allowing fastening of said second switch element on the printed circuit board; and wherein said locking pin is movable forwardly in said second switch element via an opening of said second switch element on a side facing the printed circuit board.

5. The switch housing as claimed in claim 4, wherein said locking pin is formed symmetrically relative to a longitudinal axis of said locking pin, and has at least two cams.

6. The switch housing as claimed in claim 1, wherein said second switch element has a mounting core with openings at both ends of the core, and wherein the core enables securing of at least one end of said second switch element by engagement with a complementary part of said first switch element.

7. A switch housing for an electric switch, the housing being suitable for positioning the switch at a front plate by means of a fastening element, and wherein a stop surface is located on a front end of the housing for contacting the front plate, wherein there is located on a rear of the housing a mounting surface which is parallel to the stop surface and enables the switch housing to be fastened via the mounting surface on a printed circuit board, wherein the switch housing comprises:

first and second switch elements such that one of said switch elements is connectable with the front plate, and that the other of said switch elements is connectable to the printed circuit board;

wherein one of said switch elements has a clip and the other of said switch elements has a locking pin, and the clip is adapted for connection with the locking pin for enabling said first and second switch elements to make effective functional contact with one another;

wherein said second switch element has a cavity, and said first switch element comprises an operating key and two clip arms which engage in the cavity of said second switch element, while allowing fastening of said second switch element on the printed circuit board; and wherein said locking pin is movable forwardly in said second switch element via an opening of said second switch element on a side facing the printed circuit board;

wherein said locking pin is formed symmetrically relative to a longitudinal axis of said locking pin, and has at least two cams; and wherein electric contacts are arranged on said first switch element in a fashion parallel to a longitudinal axis of the switch housing, and the electric contacts being movable into an opening provided in a switch unit of the second switch element.

8. A switch housing for an electric switch, the housing being suitable for positioning the switch at a front plate by means of a fastening element, and wherein a stop surface is located on a front end of the housing for contacting the front plate, wherein there is located on a rear of the housing a mounting surface which is parallel to the stop surface and enables the switch housing to be fastened via the mounting surface on a printed circuit board, wherein the switch housing comprises:

first and second switch elements such that one of said switch elements is connectable with the front plate, and that the other of said switch elements is connectable to the printed circuit board;

wherein one of said switch elements has a clip and the other of said switch elements has a locking pin, and the clip is adapted for connection with the locking pin for enabling said first and second switch elements to make effective functional contact with one another;

wherein said second switch element has a cavity, and said first switch element comprises an operating key and two clip arms which engage in the cavity of said second switch element, while allowing fastening of said second switch element on the printed circuit board; and wherein said locking pin is movable forwardly in said second switch element via an opening of said second switch element on a side facing the printed circuit board; and wherein the locking pin engages in the cavity of said second switch element, thereby enabling said second switch element to be fastened on the printed circuit board, wherein said two clip arms are pushable forward via a further opening of said second switch element on a side facing the front plate into said second switch element and around said locking pin.

9. The switch housing as claimed in claim 8, wherein the clip arms open in the cavity provided in the second switch element for gripping the locking pin.

10. A switch housing for an electric switch, the housing being suitable for positioning the switch at a front plate by means of a fastening element, and wherein a stop surface is located on a front end of the housing for contacting the front plate, wherein there is located on a rear of the housing a mounting surface which is parallel to the stop surface and enables the switch housing to be fastened via the mounting surface on a printed circuit board, wherein the switch housing comprises:

first and second switch elements such that one of said switch elements is connectable with the front plate, and that the other of said switch elements is connectable to the printed circuit board;

wherein one of said switch elements has a clip and the other of said switch elements has a locking pin, and the clip is adapted for connection with the locking pin for enabling said first and second switch elements to make effective functional contact with one another;

wherein the locking pin has a locking head, and the clip is connectable with the locking head of the locking pin; and wherein the clip is of rigid configuration and has at least two clip arms, and said locking pin comprises two spring limbs which are insertable resiliently into the rigid clip.

* * * * *